US006336390B1

(12) United States Patent
Sato et al.

(10) Patent No.: US 6,336,390 B1
(45) Date of Patent: Jan. 8, 2002

(54) LINEAR ACTUATOR WITH AIR CUSHION MECHANISM

(75) Inventors: Toshio Sato; Yoshiteru Ueno, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/648,543

(22) Filed: Aug. 28, 2000

(30) Foreign Application Priority Data

Oct. 1, 1999 (JP) ..... 11-281152

(51) Int. Cl.[7] ..... F15B 15/22
(52) U.S. Cl. ..... 91/406; 91/408; 91/409
(58) Field of Search ..... 91/394, 406, 408, 91/407

(56) References Cited

U.S. PATENT DOCUMENTS 729,210 A * 5/1903 Norton et al. ..... 91/409
3,138,066 A * 6/1964 Walker ..... 91/408
4,393,751 A * 7/1983 Kelley ..... 91/408

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

In a linear actuator in which a slide table on a pedestal is caused to reciprocate linearly by two air cylinder mechanisms mounted in the pedestal, exhaust holes are provided to positions adjacent at ports and, flow rate restricting mechanisms for restricting a flow rate of exhaust are provided between the exhaust holes and the ports, and pieces of cushion packing for being positioned over one of through holes of the ports on an exhaust side immediately before the piston reaches a stroke end are provided at an outer peripheral face of the piston to cause compressed air in pressure chambers of the actuator to be discharged from the exhaust hole through the flow rate restricting mechanism.

4 Claims, 3 Drawing Sheets

LINEAR ACTUATOR WITH AIR CUSHION MECHANISM

TECHNICAL FIELD

The present invention relates to a linear actuator for causing two air cylinder mechanisms mounted in a pedestal to operate synchronously to cause a slide table on the pedestal to operate linearly and more specifically relates to a linear actuator having means for stopping the slide table at a stroke end in a cushioned manner.

PRIOR ART

As disclosed in Japanese Patent Application Laid-open No. 10-61611, for example, there is a known linear actuator having two air cylinder mechanisms mounted in a pedestal and causing the air cylinder mechanisms to operate synchronously to cause a slide table on the pedestal to reciprocate linearly.

In such a linear actuator, various cushioning mechanisms are attached for stopping the slide table at a stroke end in a cushioned manner. For example, a damper elastically biased by a spring is provided to a side face of the pedestal and a contact member provided to a side face of the slide table is brought into contact with the damper at the stroke end.

However, the cushioning mechanism provided to any known linear actuator mechanically absorbs a shock, has a simple structure, and its operation is reliable, but cannot be used for some uses because a sound of the shock is produced or the cushioning mechanism projects from a side face.

On the other hand, in a normal air cylinder device, a cushioning mechanism of an air cushion type is used in which air is temporarily sealed in pressure chambers on an exhaust side in operation of pistons to increase pressure of the pressure chambers and to decelerate the pistons by the exhaust pressure, thereby causing the pistons to stop at the stroke ends in the cushioned manner.

However, because a long cushion ring is provided on at least one side of the piston and a long cushion chamber into which the cushion ring is fitted is provided in the pressure chamber in the above cushioning mechanism of the air cushion type, a length in an axial direction of a cylinder increases and a size of the linear actuator is increased if the cushioning mechanism is applied to the linear actuator. Furthermore, because the linear actuator has two air cylinder mechanisms, the size of the linear actuator is further increased if the air cushion is provided to each the air cylinder mechanism.

DISCLOSURE OF THE INVENTION

It is a technical object of the present invention to provide a linear actuator having a small and rational design structure including a cushioning mechanism of an air cushion type.

To achieve the above object, a linear actuator of the invention comprises two air cylinder mechanisms which are arranged in parallel with each other and operate synchronously, a pair of ports common to both the air cylinder mechanisms, and at least one air cushion mechanism common to both the air cylinder mechanisms, wherein the air cushion mechanism has an exhaust hole which is provided to a position adjacent to at least one of the ports and which communicates with the pressure chambers at positions closer to chamber ends than the ports, a flow rate restricting mechanism which is connected between the exhaust hole and the port and which restricts a flow rate of exhaust discharged from the pressure chambers, and cushion packing which is mounted to an outer peripheral face of one of the pistons and which gets over the port on an exhaust side immediately before the piston reaches the stroke end to cause the compressed air in the pressure chambers to be discharged only from the exhaust hole.

In the linear actuator of the invention having the above structure, if the compressed air is supplied to or discharged from the pressure chambers of the respective air cylinder mechanisms through the pair of ports, the pistons of both the air cylinder mechanisms operate synchronously and a slide table reciprocates linearly on a pedestal.

Stopping of the slide table in a cushioned manner when the slide table reaches the stroke end is carried out by synchronously decelerating the pistons of the two air cylinder mechanisms by the common air cushion mechanism. In other words, in sliding of the pistons of the respective air cylinder mechanisms, the compressed air in the respective pressure chambers on the exhaust side is discharged at first mainly through the port. When the piston approaches the stroke end and the cushion packing gets over the exhaust-side port, the port is separated from the pressure chambers and the compressed air in the pressure chambers is discharged only from the exhaust hole through the flow rate restricting mechanism in a restricted manner. As a result, the pressure in the pressure chambers is increased by control of the flow rate by the flow rate restricting mechanism and the increased pressure functions as piston back pressure to decelerate the pistons while causing the pistons to reach the stroke ends.

As described above, because the linear actuator has the cushioning mechanism of the air cushion type, the linear actuator does not produce a sound of a collision and is quiet unlike a mechanical cushioning mechanism. The linear actuator does not produce dust and can be used in a clean room and the like. If the mechanical cushioning mechanism is provided to only one side of the slide table like in prior art, the slide table is supported on the one side when it stops and therefore, an axis of the slide table is likely to incline. In the present invention, however, cushioning effect acts on the pistons of the respective air cylinder mechanisms coaxially with a direction in which thrust of the pistons is produced and the air cylinder mechanisms are synchronously decelerated. Therefore, inclination of the slide table is not generated. Furthermore, not only because the one air cushion mechanism common to the two air cylinder mechanisms is provided but also because the air cushion mechanism does not require a long cushion ring and a long cushion chamber into which the cushion ring is fitted unlike the prior art, it is possible to obtain the linear actuator with a very small and rational design structure.

According to a concrete embodiment of the invention, the flow rate restricting mechanism includes a throttle hole for restricting a flow rate of exhaust flowing from the exhaust hole toward the port and a check valve for restricting a flow of exhaust from the exhaust hole toward the port and for allowing a flow of compressed air in a reverse direction.

In this case, it is preferable that a valve chamber communicating with the exhaust hole and the ports is formed in the pedestal and the flow rate restricting mechanism is mounted into the valve chamber by disposing a valve member having the throttle hole in the valve chamber through a lip seal forming the check valve.

DETAILED DESCRIPTION

Figure 1:
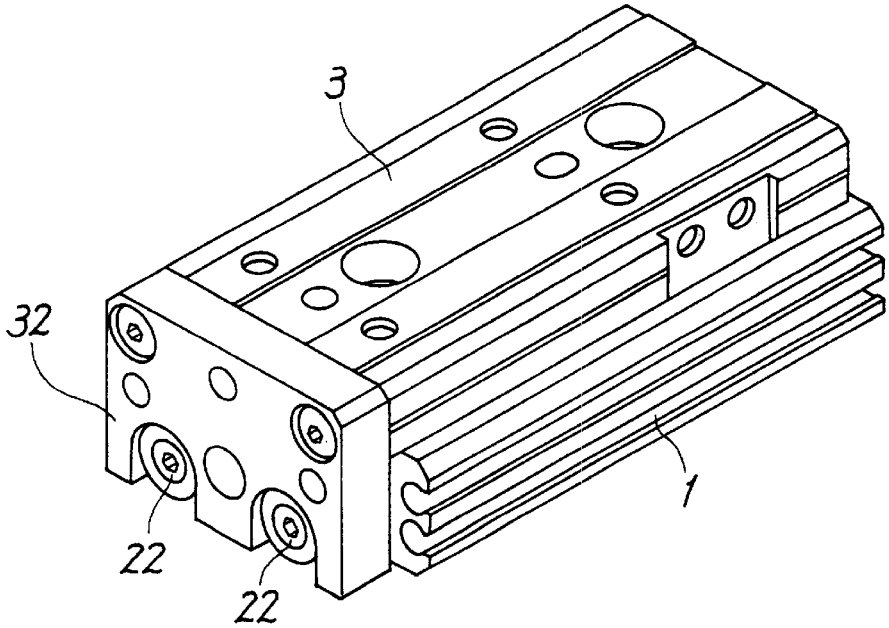
FIG. 1 is a perspective view of an embodiment of a linear actuator with an air cushion mechanism according to the present invention.
Figure 2:
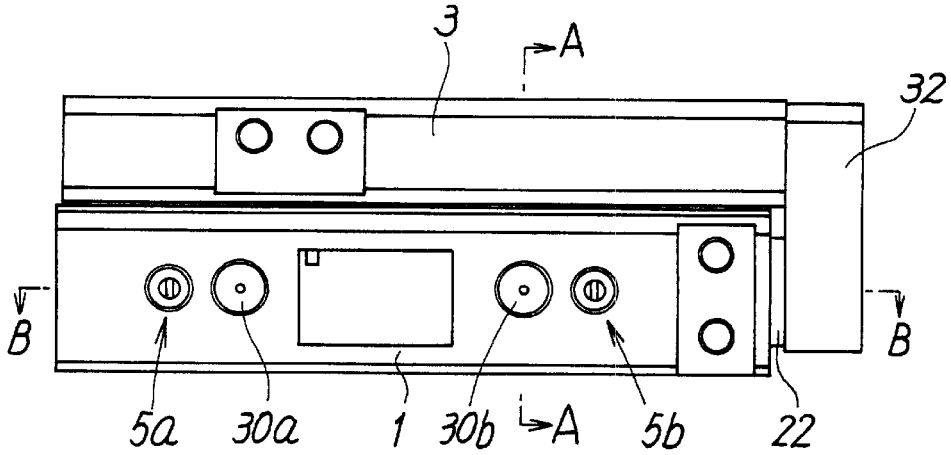
FIG. 2 is a side view of the linear actuator in FIG. 1.
Figure 3:
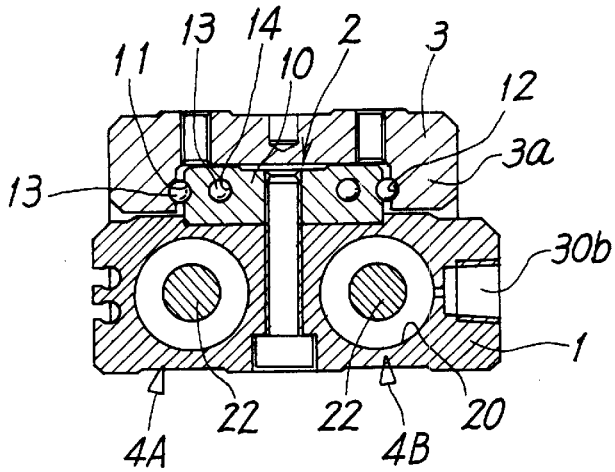
FIG. 3 is a sectional view taken along a line A—A in FIG. 2.

A preferred embodiment of the present invention will be described in detail by reference to the drawings. A linear actuator of the embodiment shown in FIGS. 1 to 5 has a pedestal 1 in a form of a flat and short prism, a linear guide 2 provided to an upper face of the pedestal 1, a slide table 3 provided to the upper face of the pedestal 1 for sliding along the linear guide 2, first and second two air cylinder mechanisms 4A and 4B which are mounted in parallel inside the pedestal 1, drive the slide table 3, and operate synchronously, and air cushion mechanisms 5*a* and 5*b* for stopping the air cylinder mechanisms 4A and 4B at stroke ends in a cushioned manner.

The linear guide 2 has a rectangular guide block 10 fixed to a central portion of the upper face of the pedestal 1, the slide table 3 is mounted astride the guide block 10, a plurality of balls 13 are respectively mounted for rolling between grooves 11 on opposite side faces of the guide block 10 and grooves 12 on inner faces of opposite guide walls 3*a* of the slide table 3, and the slide table 3 reciprocates linearly along the guide block 10 in response to rolling of the balls 13.

Balls 13 are also housed in ball holes 14 formed in parallel to the grooves 11 at positions near the opposite side end portions of the guide block 10 and the balls 13 in the grooves 11 and the balls 13 in the ball holes 14 are arranged to form annular lines. In sliding of the slide table 3, the balls 13 roll to circulate along the grooves 11 and the ball holes 14.

As is clear from FIGS. 4 and 5, the two air cylinder mechanisms 4A and 4B are mounted in parallel inside the flat pedestal 1 and have substantially the same structures except that structures of the pistons 21A and 21B are slightly different from each other as described below. In the following description, the pistons 21A and 21B will be represented by a common reference numeral "21" when they need not be distinguished from each other.

In other words, two cylinder bores 20, 20 extending in an axial direction are provided in parallel to each other on left and right within the pedestal 1, the pistons 21 are housed for sliding in the respective cylinder bores 20, and piston rods 22 connected to the pistons 21 are provided such that tip ends of the piston rods 22 project from one ends of the cylinder bores 20. End portions of the respective cylinder bores 20 on head sides are closed with head covers 24 and rod covers 25 are mounted to the end portions on rod sides. The piston rods 22 pass through the rod covers 25 such that the piston rods 22 can slide airtightly through sealing members.

Thus, on opposite sides of the pistons 21, head-side pressure chambersg 26*a* are formed between the pistons 21 and the head covers 24 and rod-side pressure chambers 26*b* are formed between the pistons 21 and the rod covers 25. Corresponding pressure chambers of the two air cylinder mechanisms 4A and 4B, i.e., the head-side pressure chambers 26*a*, 26*a* and the rod-side pressure chambers 26*b*, 26*b* respectively communicate with each other through through holes 27*a* and 27*b* formed in the pedestal 1.

A pair of ports 30*a* and 30*b* for supplying compressed supplied air to the pair of pressure chambers 26*a* and 26*b* of the first air cylinder mechanism 4A are provided to the side face of the pedestal 1 on the first air cylinder mechanism 4A side. The ports 30*a* and 30*b* are common to the two air cylinder mechanisms 4A and 4B. By supplying compressed air alternately to the head-side pressure chamber 26*a* and the rod-side pressure chamber 26*b* of the first air cylinder mechanism 4A from the ports 30*a* and 30*b* through the through holes 30*c*, the pistons 21A and 21B of the two air cylinder mechanisms 4A and 4B whose pressure chambers communicate with each other slide synchronously with each other.

A common junction plate 32 is mounted to tip ends of the piston rods 22 of the two air cylinder mechanisms 4A and 4B, the junction plate 32 is connected to the slide table 3, and the slide table 3 is driven by the two air cylinder mechanisms 4A and 4B thorough the junction plate 32.

The air cushion mechanisms 5*a* and 5*b* are common to the two air cylinder mechanisms 4A and 4B. By attaching the air cushion mechanisms 5*a* and 5*b* to the first air cylinder mechanism 4A, air cushioning operation is also generated in the second air cylinder mechanism 4B by a chain reaction. In other words, the air cushion mechanisms 5*a* and 5*b* have exhaust holes 34 which are provided to positions adjacent to the pair of ports 30*a* and 30*b* and which open into the respective pressure chambers 26*a* and 26*b* at positions closer to chamber ends than the through holes 30*c*, 30*c* and flow rate restricting mechanisms 35 which are connected between the exhaust holes 34 and the ports 30*a* and 30*b* and which restrict flow rates of exhaust discharged from the pressure chambers 26*a* and 26*b*.

Figure 6:
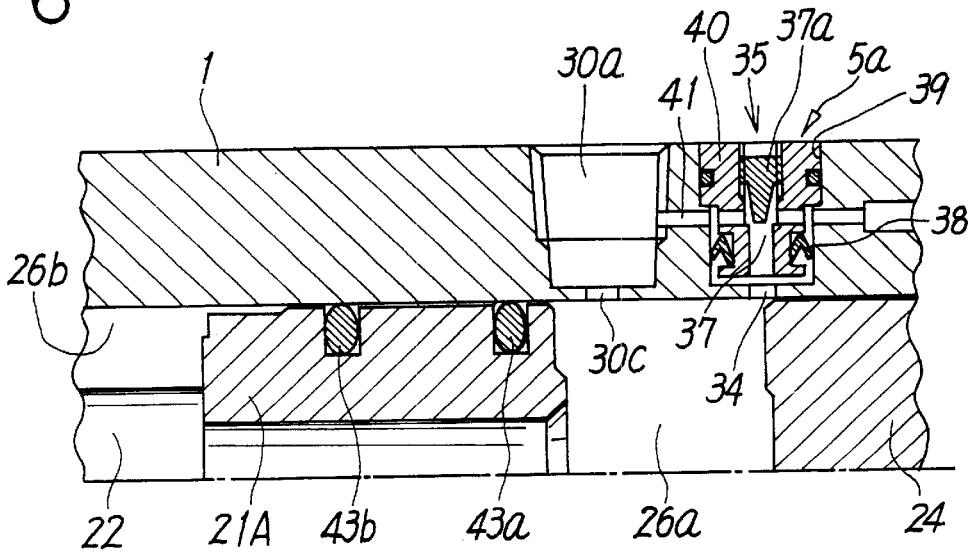
FIG. 6 is an enlarged view of an essential portion of FIG. 4.

As can be seen from FIG. 6, the flow rate restricting mechanism 35 is formed by connecting a throttle hole 37 for restricting the exhaust flow rate and a check valve 38 for intercepting a flow of exhaust that does not pass through the throttle hole 37 in parallel. The flow rate restricting mechanism 25 is housed in a valve chamber 39 formed in the side face of the pedestal 1. In other words, the valve chambers 39 that communicate with the exhaust holes 34 and both the ports 30*a* and 30*b* are formed in the side face of the pedestal 1. A valve member 40 in a form of a cylindrical column is housed in the valve chamber 39, the throttle hole 37 is formed in the valve member 40, and a lip seal forming the check valve 38 is disposed between an outer peripheral face of the valve member 40 and an inner peripheral face of the valve chamber 39. A reference numeral 41 in the drawings designates channels for connecting the valve chambers 39 and the ports 30*a* and 30*b*.

The throttle holes 37 are formed to connect the exhaust holes 34 and the ports 30*a* and 30*b*. An area of an opening of the throttle hole 37 can be adjusted by a needle 37*a* provided to the valve member 40. However, the throttle hole 37 is not limited to such a variable throttle type but may be a fixed throttle type without the needle 37*a*.

On the other hand, the check valves 38 are for intercepting exhaust other than that flowing from the pressure chambers 26*a* and 26*b* into the ports 30*a* and 30*b* through the throttle holes 37 in a cushioning stroke on a stroke end side of the pistons 21 and for allowing compressed air from the ports 30*a* and 30*b* to freely flow into the pressure chambers 26*a* and 26*b* at the start of driving of the pistons 21.

Two pieces of packing 43*a* and 43*b* are mounted to an outer peripheral face of the piston 21A of the first air cylinder mechanism 4A. The pieces of packing 43*a* and 43*b* of course have a function as piston packing for separating the two pressure chambers 26*a* and 26*b* on opposite sides of the piston 21A and also have a function as cushion packing. Immediately before the piston 21A reaches the stroke end, the packing 43*a* or 43*b* on a front side in a moving direction gets over the through hole 30*c* of the port 30*a* or 30*b* in an exhausting state such that compressed air in the pressure chamber 26*a* or 26*b* is discharged only through the exhaust hole 34. At this time, the packing 43*b* or 43*a* on a rear side in the moving direction of the piston 21A does not get over the through hole 30*c* of the exhaust-side port 30*b* or 30*a* and stops before the through hole 30*c* when the piston 21A reaches the stroke end.

Only one piece of packing 43 is mounted to an outer peripheral face of the piston 21B of the second air cylinder mechanism 4B and the packing 43 functions as piston packing.

In the linear actuator having the above structure, when compressed air is supplied alternately to the pressure chambers 26*a* and 26*b* of the two air cylinder mechanisms 4A and 4B from the two ports 30*a* and 30*b*, the pistons 21A and 21B of both the air cylinder mechanisms 4A and 4B operate synchronously and the slide table 3 moves along the linear guide 2 through the piston rods 22, 22 and the junction plate 32. At this time, stopping of the slide table 3 at the stroke end in the cushioned manner is carried out by synchronously decelerating and stopping the pistons 21A and 21B of the two air cylinder mechanisms 4A and 4B at the stroke ends by the common air cushion mechanisms 5*a* and 5*b*. This point will be described about a case of stopping the pistons 21A and 21B at the headside stroke ends in the cushioned manner by the air cushion mechanism 5*a* by using FIGS. 4 and 5.

Figure 4:
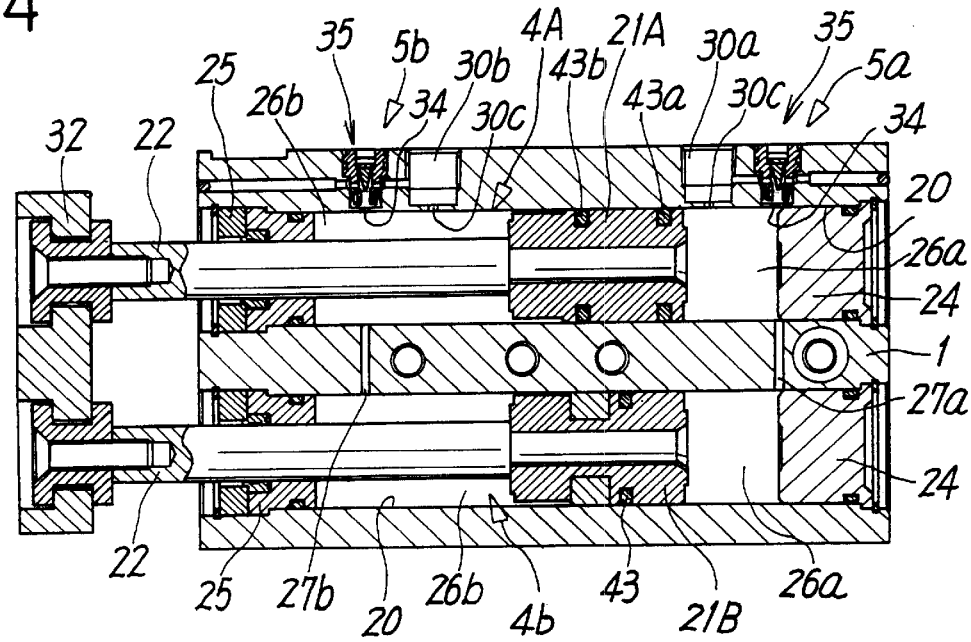
FIG. 4 is a sectional view taken along a line B—B in FIG. 2.
Figure 5:
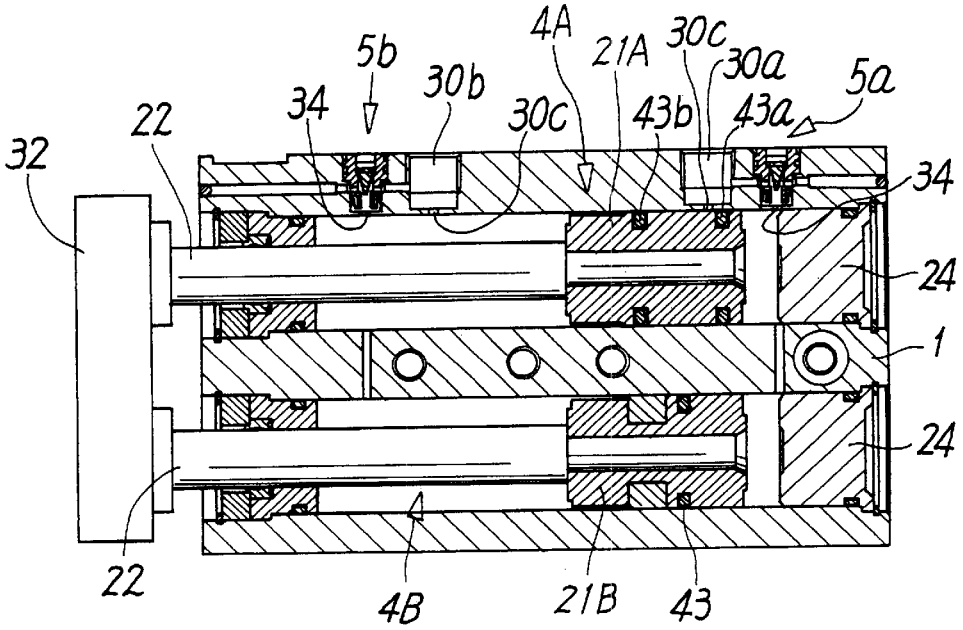
FIG. 5 is a sectional view showing an operating position different from that in FIG. 4.

In other words, as shown in FIG. 4, when the compressed air is supplied from the rod-side port 30*b* to the rod-side pressure chambers 26*b* of the air cylinder mechanisms 4A and 4B, the pistons 21A and 21B move rightward in FIG. 4 toward head sides. At this time, the compressed air in the head-side pressure chambers 26*a* that are on the exhaust side is discharged through the through hole 30*c* of the head-side port 30*a* and the exhaust hole 34. However, when the piston 21A approaches the stroke end and packing 43*a* on the front side in the moving direction gets over the through hole 30*c* of the exhaustside port 30*a* as shown in FIG. 5, the port 30*a* is separated from the pressure chambers 26*a* and the compressed air in the pressure chambers 26*a* is discharged only from the exhaust hole 34 of the air cushion mechanism 5*a* through the flow rate restricting mechanism 35 in a restricted manner. Therefore, pressure in the pressure chambers 26*ab* increases as a result of control of the flow rate by the flow rate restricting mechanism 35 and the increased pressure functions as piston back pressure to decelerate the two pistons 21A and 21B while causing the pistons 21A and 21B to reach the stroke ends.

In a case opposite to the above case, the pistons 21A and 21B move leftward in the drawing toward the rod sides from the head-side stroke ends when the compressed air is supplied to the head-side port 30*a*. At this time, the through hole 30*c* of the port 30*a* is closed between the two pieces of packing 43*a* and 43*b* on the piston 21A. However, because the compressed air from the port 30*a* pushes the check valve 38 of the flow rate restricting mechanism 35 open to freely flow into the pressure chambers 26*a*, the pistons 21A and 21B can be actuated at a predetermined speed. As shown in FIG. 4, when the packing 43*a* on the rear side in the moving direction of the piston 21A gets over the through hole 30*c* of the port 30*a*, the compressed air directly flows into the pressure chamber 26*a* through the port 30*a*. Therefore, the piston 21 continues to move.

When the pistons 21A and 21B reach the rod-side stroke ends, the rod-side air cushion mechanism 5*b* functions. In other words, when the piston 21A approaches the stroke end, the packing 43*b* on the front side in the moving direction switches a path of exhaust flowing out of the rod-side pressure chambers 26*b* from a path through which the exhaust is directly discharged from the port 30*b* through the through hole 30*c* to a path through which the exhaust is discharged in a restricted manner through the exhaust hole 34 of the air cushion mechanism 5*b* and the flow rate restricting mechanism 35. As a result, the two pistons 21A and 21B stop at the rod-side stroke ends in the cushioned manner while being decelerated.

As described above, because the linear actuator has the cushioning mechanisms of the air cushion type, the linear actuator does not produce a sound of a collision and is quiet unlike a mechanical cushioning mechanism. The linear actuator does not produce dust and can be used in a clean room and the like. If the mechanical cushioning mechanism is provided to only one side of the slide table 3 like in prior art, the slide table 3 is supported on the one side when it stops and therefore, an axis of the slide table 3 is likely to incline. In the present invention, however, cushioning effect acts on the pistons 21, 21 of the respective air cylinder mechanisms 4A and 4B coaxially with a direction in which thrust of the pistons 21, 21 is produced and the air cylinder mechanisms 4A and 4B are synchronously decelerated. Therefore, inclination of the slide table 3 is not generated. Furthermore, not only because the air cushion mechanisms 5*a* and 5*b* common to the two air cylinder mechanisms 4A and 4B are provided but also because the air cushion mechanisms 5*a* and 5*b* do not require long cushion rings and long cushion chambers into which the cushion rings are fitted unlike in the prior art, it is possible to obtain the linear actuator with a very small and rational design structure.

Although the two air cushion mechanisms 5*a* and 5*b* are provided in positions of the opposite stroke ends so as to stop the pistons 21 at normal and reverse opposite stroke ends in the cushioned manner in the above embodiment, either one of the air cushion mechanisms 5*a* and 5*b* may be provided to stop the pistons 21 at one stroke ends in the cushioned manner.

As described above, according to the invention, it is possible to obtain the linear actuator with the small and rational design structure having the cushioning mechanisms of the air cushion type.

What is claimed is:

1. A linear actuator with an air cushion mechanism comprising:

two air cylinder mechanisms each of which has a slidable piston and pressure chambers on opposite sides of said piston and which are arranged in parallel with each other;

a pedestal in which said air cylinder mechanisms are mounted;

a slide table mounted for sliding relative to said pedestal and driven by said air cylinder mechanisms;

through holes for connecting corresponding pressure chambers of said two air cylinder mechanisms;

a pair of ports for supplying compressed air to said respective pressure chambers of either one of said air cylinder mechanisms; and at least one air cushion mechanism common to both said air cylinder mechanisms for stopping said pistons of said two air cylinder mechanisms at at least one of forward and reverse stroke ends in a cushioned manner; wherein said air cushion mechanism has an exhaust hole which is provided to a position adjacent to at least one of said ports and which communicates with said pressure chambers at positions closer to chamber ends, a flow rate restricting mechanism which is connected between said exhaust hole and said port and which restricts a flow rate of exhaust discharged from said pressure chambers, and cushion packing which is mounted to an outer peripheral face of one of said pistons and which gets over said port on an exhaust side immediately before said piston reaches said stroke end to cause said compressed air in said pressure chambers to be discharged only from said exhaust hole.

2. A linear actuator according to claim 1, wherein said flow rate restricting mechanism includes a throttle hole for restricting a flow rate of exhaust flowing from said exhaust hole toward said port and a check valve for intercepting a flow of exhaust other than that from said exhaust hole toward said port through said throttle hole and for allowing a flow of compressed air in a reverse direction.

3. A linear actuator according to claim 2, wherein a valve chamber communicating with said exhaust hole and said ports is formed in said pedestal and said flow rate restricting mechanism is mounted into said valve chamber by disposing a valve member having said throttle hole in said valve chamber through a lip seal forming said check valve.

4. A linear actuator according to claim 1, wherein said air cushion mechanism is provided to each position corresponding to one of said said two ports so as to stop said pistons of said two air cylinder mechanisms at said and reverse opposite stroke ends in said cushioned manner.

* * * * *